United States Patent [19]

Anderson

[11] Patent Number: 4,754,843

[45] Date of Patent: Jul. 5, 1988

[54] ROLLER ACCESSORY FOR LADDER

[76] Inventor: Austin Anderson, R.R. 1, Box 467, Shelbyville, Ind. 46176

[21] Appl. No.: 114,505

[22] Filed: Oct. 30, 1987

[51] Int. Cl.[4] ..... E06C 7/48

[52] U.S. Cl. ..... 182/129; 182/230; 182/214

[58] Field of Search ..... 182/129, 214, 107, 108, 182/230

[56] References Cited

U.S. PATENT DOCUMENTS

| | | | |
|---|---|---|---|
| 548,111 | 10/1895 | Cardarelli | 182/129 |
| 1,948,577 | 2/1934 | Harsen | 182/214 |
| 2,597,902 | 5/1952 | Roketa | 182/214 |
| 2,704,178 | 3/1955 | Nilsson | 182/207 |
| 3,941,341 | 3/1976 | Brogdon | 182/129 |
| 4,164,268 | 8/1979 | Jones | 182/129 |
| 4,394,887 | 7/1983 | Spinks | 182/107 |
| 4,440,263 | 4/1984 | Smith | 182/107 |

*Primary Examiner*—Reinaldo P. Machado
*Attorney, Agent, or Firm*—Robert A. Spray

[57] ABSTRACT

A roller device for a ladder-top, which provides roller-facilitated ease in moving the ladder-top along a wall to change the ladder's inclination.

The roller device is characterized by its support factors which provide great ease of its attachment to existing ladders, by using the top rung or step of the ladder as one of the supports; and, providing particular advantage for extension ladders, the overall length of the roller device is limited to provide that when used on the inner section of an extension ladder, the roller device will freely pass by the extension-limiting stop-lug of the outer section, thus permitting full removal of the inner ladder-section from the outer ladder-section in spite of the purposely-blocking presence of that stop-lug, without removal or any change of the roller device.

9 Claims, 1 Drawing Sheet

ROLLER ACCESSORY FOR LADDER

FIELD AND BACKGROUND OF THE INVENTION

The present invention relates to ladders, of both single-section types and multiple-section type, and more particularly relates to and provides a novel roller device as an accessory for a ladder-top, which provides roller-facilitated ease in moving the ladder-top along a wall to change the ladder's inclination.

The Invention, in summary form, shows departure from other ladder-top accessories The ladder-top roller device of the present invention is characterized by its support factors which provide great ease of its attachment to existing ladders, including one support direct from the ladder's side-rails and by an achievement of easily-connected support by the top rung or step of the ladder as another one of the supports; and the invention provides particular advantage for so-called "extension" ladders by providing that the overall length of the roller device is limited so as to provide that when used on a relatively inner section of an extension ladder, the roller device will freely pass by the extension-limiting stop-lug of a relatively outer section, thereby permitting full removal of the inner ladder-section from the outer ladder-section in spite of the purposely-blocking presence of that stop-lug, without removal or any change of the roller device.

None of the prior art of the inventor's awareness, including so-called ladder "standoff" devices, provides the particulars of those features, as now shown.

The Prior Art has never achieved the Invention

The existence of ladder-top articles and knowledge of the prior art is not only conceded, it is emphasized; for it is with similarities to those known components and concepts of the prior art that the present inventive concepts build, accomplishing a device of a construction and an operativity significantly and advantageously different than provided by the components and operativities of the ladder articles and accessories of the prior art; and thus the inventive significance of the present concepts is emphasized, and the nature of the concepts and their results can perhaps be easier understand.

Even further as indicating the inventive nature of the present concepts is the result of a Preliminary Patentability Search made in the Search files of the U.S. Patent Office, after this invention was made, during the course of considering the desire and likelihood of patent protection.

That Search produced three references, all being U.S. patents, as follows:

| U.S. Pat. No. | Patentee | Date |
|---|---|---|
| 2,704,178 | Nilsson | 3/15/55 |
| 4,394,887 | Spinks | 7/26/83 |
| 4,440,263 | Smith | 4/3/84 |

These cited patents of the prior art each mention other and earlier patents, showing that these ladder-top roller devices, and their need for various improvements through the years, have existed even longer than indicated by the particular patents.

The deficiencies of the cited prior art patents, as failing to show or suggest the concepts of the present invention, are now summarized:

a. The Nilsson device has rollers (8, 11, 17, and 18), but they relate to extendability of the ladder-sections; and although Nilsson also shows a ladder-end wheel (6) it is not particularized at all, and thus must be assumed to not provide the particular features of the present invention.

b. The Spinks device represents a "standoff" device; but its axle is much too long to permit the section-disassembly feature, and does not provide the easy-attachment combination concepts of one support set direct from the ladder's side-rails and one by an embrace of the top rung or step.

c. As to the Smith device cited, it fails even more than Nilsson to show or suggest a length-limitation to permit the easy section-disassembly mentioned above; and the Smith device, even in its various embodiments, fails to show the easy-attachment features of the present invention.

Accordingly, the various concepts and components and knowledge factors of the prior art are conceded and emphasized to have been known in the prior art of ladder manufacture and use; nevertheless, with the prior art not having had the particular present concepts, even only a fair amount of realistic humility, to avoid consideration of this invention improperly by hindsight, requires the concepts and achievement here to be realistically viewed as inventive in their nature.

BRIEF DESCRIPTION OF THE DRAWINGS

The above description of the novel and advantageous ladder-top roller device, and its novel combination of features, is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing of the inventive concepts as are illustrated in these embodiments:

FIG. 2 is a detail view, partly in section, showing the roller accessory and the top portion of the inner ladder-section; and FIG. 3 is a detail view, as would be seen according to Section-line 3-3 of FIG. 2.

DETAILED DESCRIPTION OF PREFERRED EMBODIMENT OF THE INVENTION

Figure 3:
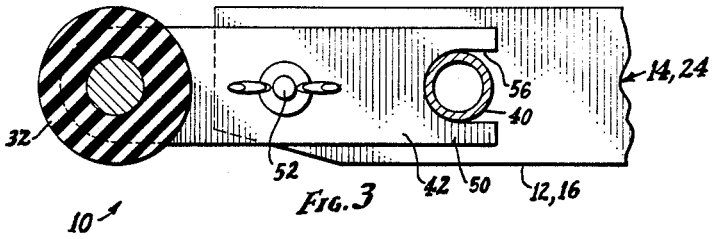
FIGS. 2 and 3, in enlarged scale, are detail views of the roller accessory shown assembled to the top portion of the inner ladder-section; and more particularly these views are as follows.

As shown in the drawings, the inventive concepts provide a new and advantageous roller device 10 for easy mounting onto the top portion 12 of a ladder 14; and an advantage of the roller device 10 of the form shown, and as described herein, is that it may be easily attached to existing ladders 14.

Extra advantage is provided by the present concepts for a ladder 14 of so-called "extension type" having two or sometimes more sections, shown in the drawings as an inner ladder-section 16 and an outer ladder-section 18, as explained further herein; although, as explained herein, the roller device 10 provides special advantages over other roller devices for just single-section ladders 14 which do not have extension-capability, that special advantage being as to its support or mounting, and correspondingly its ease of attachment to the ladder 14.

Since the roller device 10 is attached to the inner or "extension" section 16 of the ladder 14, just the same way as it is attached to the single section of a non-extendible ladder 14, it will be described here as being mounted onto the inner (or extension) section 16 of an extension ladder; and it will be understood that such description also applies to mounting on a single section of a non-extendible ladder 14.

A multi-section or extension ladder 14 conventionally has its relatively inner section 16 slidably supported by its relatively outer section 18; and the relatively inner section 16 and the relatively outer section 18 conventionally have the safety components of a co-operative abutment lug means 20/22 which are operatively inter-engageable to limit the travel of the relatively inner ladder-section 16 along the relatively outer ladder-section 18 when the ladder's inner section 16 is being slid in a direction of extension along the ladder's outer section 18.

This engagement of lugs 20/22, the lug 20 being outwardly-extending from the ladder's inner section 16's side rail 24 (or both of its side rails 24 if both rails 24 have a lug 20), and lug 22 being inwardly-extending from the ladder's outer section 18's side rail 26 (or both of its side rails 26 if both rails 26 have a lug 22), co-operate to provide the safety of preventing excess extension-direction movement of the relatively inner ladder-section 16, even though the support of the relatively inner ladder-section 16 by the relatively outer ladder-section 18 is such as to permit the sliding travel movement of the relatively inner section 16 along the relatively outer section 18 in the non-extending direction for permitting disassembly of the relatively inner ladder-section 16 from the relatively outer ladder section 18 when the user desires to use the ladder sections 16 and 18 independently of one another.

(This factor of stop-lugs 20/22 for extension ladders 14 is needed to be recalled in realizing one of the advantages of the concepts here of the roller device 10, even though the lugs 20/22 form no part of the present invention.)

Further with respect to conventional extension ladders 14, it is to be noted that the extension operability of the relatively inner ladder-section 16 and the relatively outer ladder-section 18 is such that the top portion 12 of the relatively inner ladder-section 16 travels outwardly away from the top portion 28 of the relatively outer ladder-section 18; and the safety-stop or extension-limiting operativity is provided by the lug means 20 of the relatively inner section 16 being relatively adjacent the bottom portion 30 of the relatively inner ladder-section 16, and the lug means 22 of the relatively outer ladder-section 18 being relatively adjacent the top portion 28 of the relatively outer ladder-section 18.

For the extension ladder's inner section 16, or for a non-extendible ladder's only section, although with extra advantage herein described for an extension ladder and thus described in that use, there is shown as provided for the relatively inner ladder-section 16 a roller means 10. The roller means 10 has a cylindrical body member 32, and it is carried outwardly of the top portion 12 of the relatively inner ladder-section 16 and is supported on the ladder-section 16's top portion 12 in a manner in which it is revolvable about an axis 34 perpendicular to the length of the relatively inner section 16. The roller device 10, by rolling engagement of its body member 32 against a support wall 36, provides that if the ladder 14 is positioned in an inclined manner along a wall means 36 such that the wall means 36 supports the ladder 14 by the engagement of the roller means roller body 32 against the wall means 36, and if the inclination of the ladder 14 is changed with the roller means' roller body 32 rolling along the wall means 36, the rolling action of the roller means' roller 32 facilitates the inclination-changing of the ladder 14 especially if the wall has a rough texture. The rubber or rubber-like texture of the roller body 32 helps provide safety of the ladder-top 12 sliding sideways along the wall 36.

Figure 2:
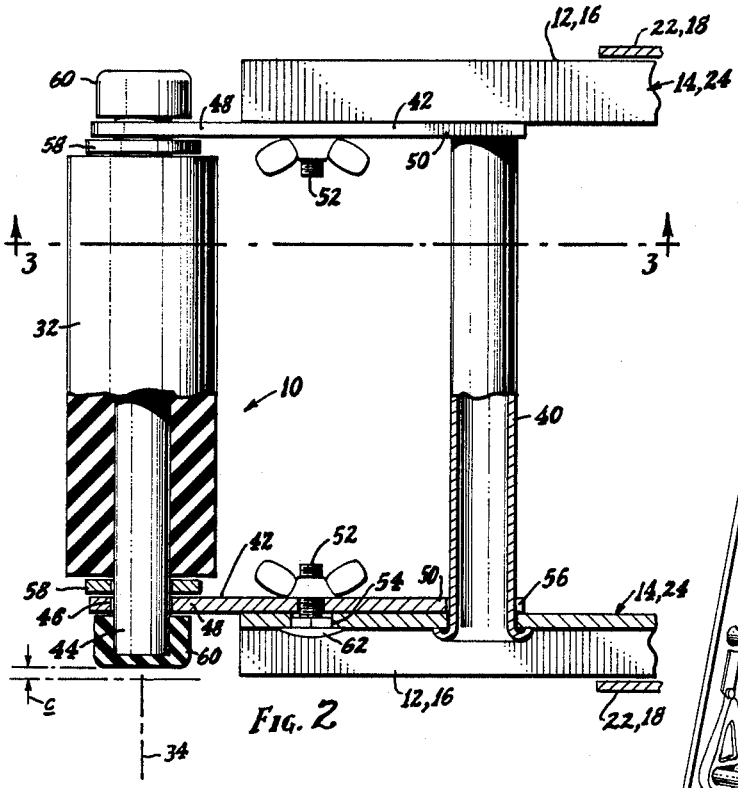
Figure 1:
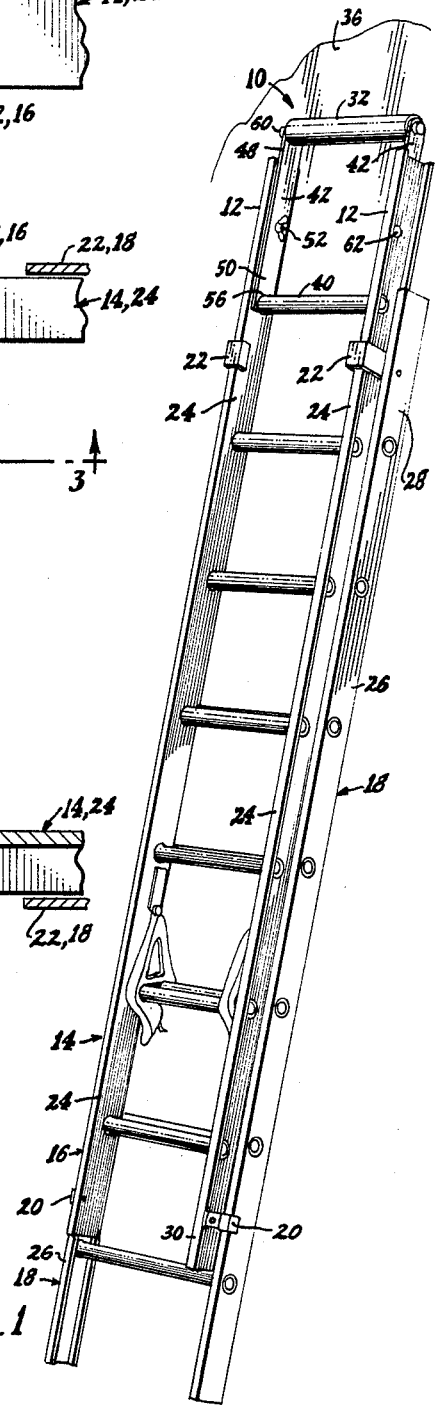
FIG. 1 is a pictorial view of an extension ladder provided with a ladder-top roller accessory of the present invention. The ladder here illustrated is formed of metal, and of a two-section type, the two ladder-sections being shown assembled together, and in a relative position of minimal extension.

In keeping with the concepts providing special advantage in use of the concepts with ladders of extension type (here shown of multi-section type having an inner section 16 and its most-adjacent outer section 18), the entirety of the roller means 10, including roller body 32 and its supporting structure, is inwardly of the outer limits (thus inwardly of the outer limits of the inner section 16's rails 24 and lug 20) of the relatively inner ladder-section 16 an amount such that, if the relatively inner ladder-section 16 is moved in the non-extending direction, the entirety of the roller means 10 will freely pass past the lug means 22 of the relatively outer ladder-section 18, this relatively thus permitting travel of the relatively inner ladder-section and the roller means 10 which is carried thereby to be moved, i.e., slid relative to the outer ladder-section 18 in the non-extending direction fully to permit full disassembly of the relatively inner ladder-section 16 from the relatively outer ladder-section 18 without removal or other change of the roller means 10 from its support by the relatively inner ladder-section 16. (That clearance is indicated at "c" in FIG. 2.)

The novel support features of the roller device 10, as stated above, also provide advantages with a ladder 14 which is non-extendible and thus poses no problem of abutment with the stop-lug 22, and as now described, provides support advantages in combination with the opposite sides' side rails 24 and whatever is the top portion 12's uppermost step or rung 40 extending between and supportively connected to the ladder's side rails 24.

More particularly as shown, the roller means 10 includes a pair of spaced support arms 42, and the roller's cylindrical body member 32 has ends 44 (on axis 34) which are revolvably supported by the support arms 42 in holes 46 which are provided adjacent the outer ends 48 of the support arms 42; and the inner ends 50 of the support arms 42 are supportively connected to the top step/rung 40.

Even more particularly as shown, the support arms 42 are each connected to a respective one of the side rails 24, as by a bolt 52 at a location along the respective support arm 42 intermediate the locations therealong of supporting connections to the roller body ends 44 and to the top step/rung 40.

The hole 54 in each side-rail 24 to accommodate the respective bolt 52 is the only alteration of the ladder 14 (inner section 16) which needs to be done; for the roller-support is made strudy, and the assembly made very convenient, as shown, by the provision that the supportive connection of the support arms 42 to the top step/rung 40 is provided by providing a recess throat 56 in the inner end portion 50 of each support arm 42, and the step/rung 40 as shown is received in the recess throats 56 of the two support arms 42.

A washer 58 is shown provided on the rod-like support end 44 of the roller body member 32, between that body member 32 of the roller device 10, and the support arm 42; and an end cap 60 of rubber or rubber-like material is affixed onto that support-end 44, minimizing scratching or scraping harm to the associated wall 36.

It will be noted that the bolt 52 is desirably of a type such as a so-called "carriage bolt" having a very thin and flat head 62, or having the bolt-head countersunk, avoiding any problem of inadvertent contact with the stop-lug 22 of the outer ladder-section 18. (An "elevator bolt" is similarly desired.)

In considering the terms "inner" and "outer" in the description hereof, they are used to laterally distinguish the two (or more) ladder-sections 16/18, but also in a longitudinal sense to indicate the protrusion of the roller device 10 over the top end 12 of the ladder; but with the operativity factors in mind, there should not be confusion in the use of those terms.

CONCLUSION

It is thus seen that a ladder-top roller-accessory device constructed and used according to the inventive concepts herein set forth, provides novel concepts of a desirable and advantageous device, yielding the advantages of a rolling-assisted movability of a ladder to change its inclination along the wall against which it is leaning. The device provides the advantages herein indicated, as to providing for the easy attachment of the roller device to existing ladders, being quite useful as a ladder-top roller for both single-section ladders and for so-called "extension" ladders of two or more sections. A special advantage, when used with multiple-section ladders, is that the roller device avoids interference with the stop-abutments which provide safety against undue or unsafe extension of inner ladder-sections, thus accommodating full separation of the ladder-sections when it is desired to use the ladder with less than all its sections.

In summary as to the nature of these advantageous concepts as herein specified, their inventiveness is shown by novel features of concept and construction shown herein, and by the novel concepts hereof not only being different from all the prior art known, but because the achievement of its specific details is not what is or has been suggested to those of ordinary skill in the art, especially realistically considering this as comprising components such as relationships and support concepts which individually are similar certain respects to what is well known, surely including most of the many makers and users of ladders for many years, the entire world over, a substantial number of all ladder-users surely having realized a difficulty in changing the lean-inclination of ladders, and even persons who have used any form of roll-top ladders having experienced difficulty in separating ladder-sections when desiring to use less than all its sections for the task at hand.

And even though ladders of the prior art have had certain types of roller-tops, which have been known for many years, no prior art has suggested the particulars of modifications of any prior art to achieve specific novel concepts here achieved, and quite certainly no particular combination of prior art has been suggested by the prior art to achieve the present particulars, this achievement being a substantial and advantageous departure from prior art, even though the prior art having had a multitude of types of ladders shows various attempts at their improvement for years. And particularly is the overall difference from the prior art significant when the non-obviousness is viewed by a consideration of the subject matter as a whole, as integrally incorporating the features different from the prior art, in contrast to merely those details of novelty themselves, and further in view of the prior art teaching away from the particulars of this invention.

Accordingly, it will thus be seen from the foregoing description of the invention according to this illustrative embodiment, considered with the accompanying drawings, that the present invention provides new and useful concepts of a novel and advantageous ladder-top roller device having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown. For example, although the ladder 14 is shown of metal for illustrating the use of the roller device 10, the device may as easily be used with a ladder of wood or other material, with the need of adaption being only the provision of a single hole 54 in each inner-section side-rail 24. Likewise the ladder-steps may be steps or rungs, and thus they are sometimes referred to herein as "step/rung"; and it will be understood that the support-arm throats 56 may be appropriately sized and shaped to achieve support from whatever is the nature of the step/rung of whatever ladder is used. Other illustrative alternatives have already been mentioned.

I claim:

1. An accessory for a multi-section extension ladder having a relatively inner section slidably supported by a relatively outer section, and the relatively inner section and the relatively outer section having co-operative lug means operatively interengageable to limit the travel of the relatively inner section along the relatively outer section in a direction of extension of the relatively inner section along the relatively outer section so as to prevent excess extension-direction movement of the relatively inner section, but the support of the relatively inner section by the relatively outer section being such as to permit travel of the relatively inner section along the relatively outer section in the non-extending direction such as to permit disassembly of the relatively inner section from the relatively outer section when it is desired to use the relatively inner section or the relatively outer section independently of one another, the relatively inner section and the relatively outer section each having a top portion and a bottom portion, the extension operability of the relatively inner section and the relatively outer section being such that the top portion of the relatively inner section travels outwardly away from the top portion of the relatively outer section, the lug means of the relatively inner section being relatively adjacent the bottom portion of the relatively inner section, and the lug means of the relatively outer section being relatively adjacent the top portion of the relatively outer section, there being provided for the relatively inner section a roller means carried outwardly of the top portion of the relatively inner section and supported thereby in a manner in which it is revolvable about an axis perpendicular to the length of the relatively inner section, providing, if the ladder is positioned in an inclined manner along a wall means such that the wall means supports the ladder by the engagement of the roller means against the wall means, and if the inclination of the ladder is changed with the roller means rolling along the wall means, such rolling action of the roller means facilitates the inclination-changing of the ladder, the improvement, comprising the provision of the entirety of the roller means inwardly of the outer limits of the relatively inner section of the ladder an amount such that, if the relatively inner section is moved in the non-extending direction, the entirety of the roller means will freely pass past the lug means of the relatively outer section of the ladder, thus permitting travel of the relatively inner section and the roller means carried thereby to be moved in the non-extending direction fully to permit full disassembly of the relatively inner section from the relatively outer section, and without removal or other change of the roller means from its support by the relatively inner section of the ladder.

2. The invention as set forth in claim 1, in a combination in which the relatively inner section is of a type having a pair of side rails, and is provided in its top portion with a step/rung extending therebetween and supportively connected thereto, the roller means including a pair of support arms, and a roller body having ends which are revolvably supported by the support arms adjacent the outer ends of the support arms, and the support arms having inner ends which are supportively connected to the said step/rung.

3. The invention as set forth in claim 2, in a combination in which the support arms are connected to the said side rails at a location along said support arms intermediate the locations therealong of supporting connections to the roller body and to the said step/rung.

4. The invention as set forth in claim 3, in a combination in which the supportive connection of the support arms to the said step/rung is provided by providing a recess throat in the inner end portion of each support arm, and the step/rung is received in the said recess throats.

5. The invention as set forth in claim 1 in a combination in which the roller means is generally of a cylindrical shape, and is provided to have its cylindrical exterior surface to be covered with rubber or rubber-like material.

6. An accessory for a ladder having a roller means carried outwardly of the top portion of the ladder and revolvable about an axis perpendicular to the length of the ladder, providing, if the ladder is positioned in an inclined manner along a wall means such that the wall means supports the ladder by the engagement of the roller means against the wall means, and if the inclination of the ladder is changed with the roller means rolling along the wall means, such rolling action of the roller means facilitates the inclination-changing of the ladder, the ladder being of a type having a pair of side rails, and is provided in its top portion with a step/rung extending therebetween and supportively connected thereto, the roller means having a pair of support arms, and a roller body having ends which are revolvably supported by the support arms adjacent the outer ends of the support arms, in a combination in which the support arms have inner ends which are supportively connected to the said step/rung, and the support arms are connected to the said side rails at a location along said support arms intermediate the locations therealong of supporting connections to the roller body and to the said step/rung.

7. The invention as set forth in claim 6, in a combination in which the supportive connection of the support arms to the said step/rung is provided by providing a recess throat in the inner end portion of each support arm, and the step/rung is received in the said recess throats.

8. The invention as set forth in claim 6 in a combination in which the roller means is generally of a cylindrical shape, and is provided to have its cylindrical exterior surface to be covered with rubber or rubber-like material.

9. The invention as set forth in claim 7 in a combination in which the roller means is generally of a cylindrical shape, and is provided to have its cylindrical exterior surface to be covered with rubber or rubber-like material.

* * * * *